US006137750A

United States Patent [19]

Rieben

[11] Patent Number: 6,137,750

[45] Date of Patent: Oct. 24, 2000

[54] SAFETY VALVE FOR A TIMEPIECE

[75] Inventor: Hans Rieben, Bettlach, Switzerland

[73] Assignee: Meco SA Grenchen, Grenchen, Switzerland

[21] Appl. No.: 09/090,312

[22] Filed: Jun. 4, 1998

[30] Foreign Application Priority Data

Jun. 11, 1997 [CH] Switzerland ..... 1418/97

[51] Int. Cl.[7] ..... G04B 37/00

[52] U.S. Cl. ..... 368/290; 368/319

[58] Field of Search ..... 368/288–290, 368/308, 319–321

[56] References Cited

U.S. PATENT DOCUMENTS 3,376,701 4/1968 Grohoski et al .
3,475,901 11/1969 Soguel .
3,485,036 12/1969 Feurer .
4,292,682 9/1981 Wenger ..... 368/289

FOREIGN PATENT DOCUMENTS 237996 6/1945 Switzerland .
682 199 8/1993 Switzerland .
2045 478 10/1980 United Kingdom .

OTHER PUBLICATIONS

Patent Abstracts of Japan, vol. 006, No. 038 (P–105), Mar. 9, 1982 & JP 56 155882 A (Seiko Instr. &.

*Primary Examiner*—Vit Miska
*Attorney, Agent, or Firm*—Griffin & Szipl, P.C.

[57] ABSTRACT

A safety valve with an element rigid with the housing and with an operable element which is movable with respect to this. Between these two elements there is arranged a lip seal with an elastic lip, which bears on the element rigid with the housing and delimits the timepiece inner space from the surroundings. By way of the fact that the lip is led in the direction of the surroundings conically onto the element rigid with the housing and lies on this element with pretensioning, on the one hand with an inner space excess pressure it may release itself from the element rigid with the housing for the purpose of pressure compensation between the inner space and the surroundings and on the other hand with a surrounding excess pressure it is more strongly pressed on the element rigid with the housing for the purpose of sealing the inner space with respect to the surroundings.

17 Claims, 1 Drawing Sheet

10
11
68
18
76
74
86
92
78
94
72
70
82
67
66
28
90
84
88
64
52
29
65
50
58
43
56
48
54
60
24
46
80
40
62
25
39
41
27
12
42
44
31
26
32
30
98
19
96
35
20
38
34
23
14
22
16
102
106
100
104
36

SAFETY VALVE FOR A TIMEPIECE

BACKGROUND OF THE INVENTION

The present invention relates to a safety valve for a timepiece, according to the introductory part of claim 1.

From CH 682 199 it is known to equip a timepiece with a safety valve in order to prevent in the inside of the timepiece an excess pressure with respect to the pressure of the surroundings, which forms under certain conditions.

An excess pressure in the inside of the timepiece may have the following origin:

If a timepiece, proceeding from a situation in which the inner pressure firstly corresponds to the outer pressure, is subjected to a higher pressure in the surroundings then it is possible for some matter to diffuse through the sealing means into the inside of the timepiece and thus cause an increase in pressure in the inside of the timepiece, or an adaptation of the pressure. If this timepiece is then subsequently subjected to a significantly lower pressure of the surroundings within a relatively short time, then the excess pressure in the timepiece existing with respect to the surroundings may for example lead to the fact that the timepiece glass bursts open and sensitive components of the timepiece are damaged.

Such changes in pressure may for example occur in the process of diving, be the timepiece in gaseous surroundings such as is the case with a diving bell, or directly located in the water. Amongst the substances which may diffuse through seals into the inside of the timepiece is above all to be mentioned the element helium with its very small atomic dimension. Helium not only penetrates into the timepiece when it is subjected to the helium atmosphere common to diving bells, but also dissolves out of the water at great depths, i.e. at a high pressure.

The safety valve shown in the above mentioned document CH 682 199 comprises two O-rings and a screwable cover for closing the valve. With an unscrewed lid only one of the two seals functions, whereas with a screwed down lid, both arranged behind one another ensure an improved sealing. The lid is screwed down before the diving procedure and the valve closed, so that on diving, with an increasing pressure of the surroundings, the entry of material with larger atomic dimensions such as water and dirt particles can be prevented. In order subsequently to effect a rapid reduction of the excess pressure forming with a jump-like part ascent, before the ascent the cover is to be unscrewed and the valve to be released so that helium may escape.

In the case that the lid is not screwed down before the diving procedure, small quantities of water and dirt particles may reach into the inside of a timepiece and the sealing properties of the safety valve may worsen.

BRIEF SUMMARY OF THE INVENTION

It is therefore an object of the present invention to provide a safety valve which:

- with an excess pressure of the surroundings seals excellently,
- with a negative pressure of the surroundings permits a rapid pressure compensation,
- as well as keeps away dirt particles from the sealing region and from the inside of the timepiece.

The solution according to the invention results from the features of claim 1.

By way of the fact that the safety valve according to the invention is equipped with a lip seal which is orientated such that the concentric, skirt-shaped lip faces from the inner space of the timepiece to the surroundings, the lip with an increasing excess pressure of the surroundings is pressed more heavily on the cylinder jacket shaped surface region, from which there results an excellent sealing.

Reversely with an excess pressure in the timepiece the lip is advantageously deformed in a manner such that it is pressed away from the cylinder jacket shaped surface region and forms a passage for an effective reduction in pressure.

The lip seal thus acts without additional displaceable elements as an automatically actuating valve.

Furthermore the lip seal in the suggested alignment has the advantage that it acts as a dirt deflector and thus prevents the access of dirt particles to the sealing region as well as to the inside of the timepiece. By way of this the sealing region remains constantly clean and the danger of entry of water is considerably reduced. For example an additionally provided sealing ring in this way likewise remains clean and its sealing quality remains, in particular with regard to water.

Sealing region is to be understood as the contact surfaces of the seal as well as of the safety valve or of the timepiece in contact with this, i.e. surface regions of the seal as well as surface regions for example of the outer and inner walling of the sleeve, of the cover etc., according to the embodiment form of the safety valve according to the invention.

With respect to an O-ring, with the lip seal there is yet a further advantage of considerable importance: O-rings on account of their manufacture comprise a circular seam which is located at the location of the largest circumferential line. With seals of small dimensions, this seam, as is the case in the field of timepiecees, is characterized by prominent irregularities of the surface, which considerably compromise their sealing qualities. With a lip seal on the other hand, at the sealing locations, i.e. in those regions which are in contact with the walling of the bore there are no seams present. Also this contributes considerably to the improvement of the tightness.

According to one advantageous embodiment form of the invention there is provided an additional seal which is arranged at the inner space side of the lip seal, in order for example to form a further block to the water for the diving procedure. The sealing properties of the lip seal of the safety valve according to the invention are however so superb that satisfactory results are achieved also without additional sealing.

This additional sealing according to a preferred formation of the invention is automatically compressed with an excess pressure of the surroundings in that the receding of the lip seal in the direction of the inner space is used to let a movable valve piston on which the lip seal is stationarily mounted to act on the additional seal. Reversely, with an excess pressure in the inner space the valve piston is driven in the opposite direction which means a relieving of the additional seal. The lip seal thus additionally has the advantage that it acts as a driving means in order to reinforcingly seal an additional sealing element, such as an O-ring, with an excess pressure of the surroundings, and with an excess pressure in the inner space, to bring it into the passage position.

This additional seal can, according to further formation of the invention, with an imminent excess pressure of the surroundings, be additionally pressed by hand in that the safety valve has at its disposal a screwable cover which on screwing down permits the displacement of the valve piston in the direction towards the inner space, and the compression of the additional sealing element.

The sealing properties of the lip seal of the safety valve according to the invention however are so excellent that on diving there is effected no entering of water even when the lid is not screwed down.

A spring may advantageously be so arranged that the additional sealing element is located in the precompressed condition even without the effect of the outer excess pressure or of the lid.

By way of an advantageous formation according to the invention the outer thread of the sleeve, which lies outside the centre part, comprises an annular groove which when screwing down the lid for the first time permits a deformation of a thread section so that the lid can no longer get lost.

BRIEF DESCRIPTION OF THE DRAWINGS

One embodiment form of the invention is subsequently described in more detail by way of a drawing. There is shown.

DETAILED DESCRIPTION OF THE INVENTION

Figure 1:
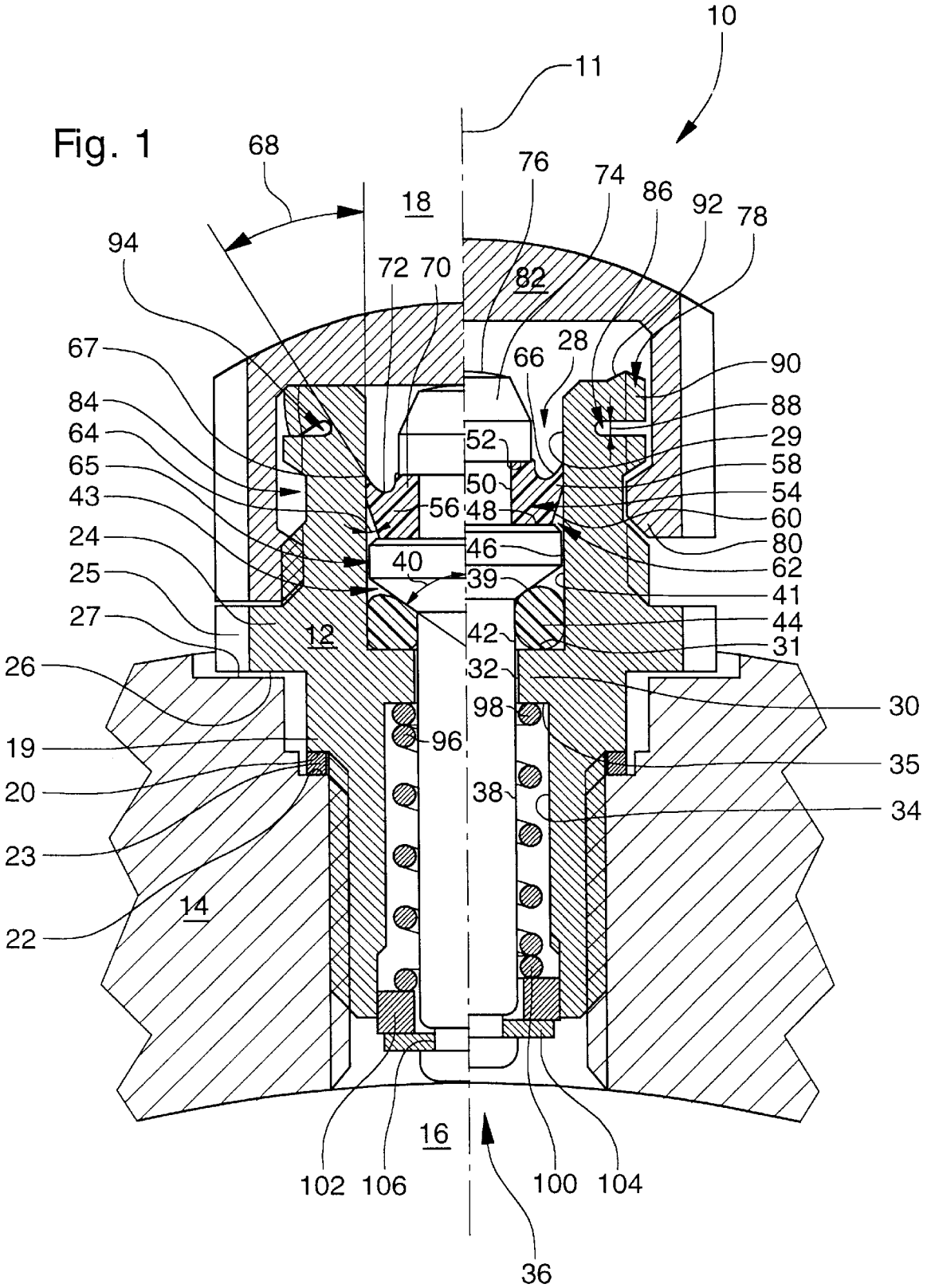
in FIG. 1, an embodiment form of the safety valve according to the invention, in an axial section.

An embodiment of the safety valve according to the invention is shown in FIG. 1. The safety valve 10 which with respect to the axis 11 is essentially rotationally symmetric, comprises a continuous hollow sleeve 12 which is screwed in a centre part 14 shown only partly or in a housing of a timepiece. In the timepiece there is defined an inner space 16 lying below in the drawing, which is hermetically sealed from the surroundings 18 lying above in the drawing.

The sleeve 12 on the outside comprises a shoulder 19 with a bearing surface 20 annulus-shaped with respect to the axis and faces the housing 14. Between this bearing surface and a corresponding annulus-shaped bearing surface 22 provided on the housing 14 there is placed a metal sealing ring 23 which at this location seals the inner space 16 from the surroundings 18.

For screwing in the sleeve 12, or rather the safety valve 10 into the centre part, for example by way of an assembly key, the sleeve 12 comprises a flange 24 facing outwardly with respect to the axis 11, with a toothing 25. On the side of the flange 24 facing the housing 14 there is provided an annular abutment surface 26 which in the screwed in position of the sleeve 12 or the safety valve 10 bears rigidly on a likewise annulus-shaped abutment surface 27 of the centre part 14, wherein in this condition the sealing ring 23 is compressed.

On the inside the sleeve 12 comprises bores of various diameters, wherein on one side of the sleeve 12, which is proximal to the surroundings 18, a bore 28 with a cylinder jacket shaped walling 29 is led to an inwardly directed flange 30 which comprises an annulus-shaped contact surface 31 which internally is delimited by a bore 32. On the other side of the sleeve 12, which faces the inner space 16 there is likewise provided a bore which is indicated at 34 and likewise extends up to the inwardly directed flange 30, wherein also on this side of the flange 30 there is likewise provided an annulus-shaped bearing surface 35 delimited by the bore 32.

In the sleeve 12 there is arranged a cylinder 36 which is arranged axially movable to this and which in the region of the bores 32 and 34 comprises a cylindrical shank 38 which protrudes up to into the region of the bore 28 and here broadens conically in the direction away from the housing and from the axis 11 until almost the walling 29 of the bore 28 and forms a contact surface 39 of the shape of an envelope of a truncated cone. In other words the truncated cone envelope is orientated such that the circumference increases in the direction to the surroundings 18, wherein between the axis 11 and this truncated cone envelope there is present an angle 40 of for example 60°.

Between the two contact surfaces 31 and 39 a part 41 of the bore 28, located in the region of the flange 30, as well as a part 42 of the shank 38 protruding into the bore 28 there is provided a concentric space 43 for receiving an O-ring 44.

Leading further away in the direction from the housing 14 there follows, on the outside on the contact surface 39 with respect to the axis 11, a short cylinder jacket shaped region 46 which is closed by an annulus-shaped contact surface 48. Connected to this contact surface 48 there leads a relatively short, cylinder jacket shaped region 50 to a further contact surface 52 which extends radially outwards and again has the shape of an annulus.

An annular free space 54 defined by the two contact surfaces 48 and 52 as well as by the cylinder jacket shaped region 50 accommodates a lip seal 56 which comprises an elastic rotationally symmetric lip 58 which broadens conically in the direction away from the housing 14 and from the axis 11 up to the walling 29 of the bore 28 and here bears with pretensioning. The lip seal 56 may be described also as a packing.

This rotationally symmetric lip 58 or skirting is in other words formed such that with regard to the axis 11 it is orientated such that the outer dimension in the direction leading away from the housing 14 essentially continuously increases and essentially has the surface of the envelope of a truncated cone. Between this surface, called the first surface region 60, and the walling 29 there is defined a rotationally symmetric free space 62 with an essentially wedge-shaped cross section and with an acute angle 64 of for example 10°.

The inner space 16 shown below in FIG. 1 leads until up to the O-ring 44. Between the O-ring 44, the lip 58, the sleeve 12 and the cover 82 there is enclosed an intermediate region 65. With regard to the function of the lip seal 56 this intermediate space 65 may however be allocated to the inner space 16 of the timepiece.

Additionally to the first surface region 60, the lip seal 56 comprises a second, rotationally symmetrical surface region 66 which likewise conically approaches the bore 28 leading away in the direction from the housing 14. Both surface regions 60 and 66 accordingly are directed in a similar direction, i.e. in the direction away from the housing 14. Between the second surface region 66 and the walling 29 there is present an angle 68 smaller than 90°, i.e. for instance 45°. Thus the lip 58 is annular wedge shaped at an angle of for example 35° and comprises in the contact region with the wall 29 an approximately pointed edge region 67.

Further the lip seal 56 comprises a base region 70 which under pretension on the one hand is arranged between opposite contact surfaces 48 and 52 and on the other hand is seated on the cylinder jacket shaped region 50.

An arcuate transition zone 72 proceeding from the contact surface 52 firstly leads in the direction of the inner space 16 and with an increasing distance from the axis 11 describes a curve in the direction of the surroundings 18 in order finally to blend into the second rotationally symmetric surface region 66.

In the direction of the surroundings 18 and following the surface area 52 the piston 36 is closed by a conically tapering head 74 which comprises an end face 76 embossed outwardly which forms an abutment. The head 74 is formed conically so that the lip seal 56 may be slipped over it in a simple manner.

On the outside, the sleeve 12 comprises an interrupted outer thread indicated at 78 for accommodating a screwable protective cover 82 provided with a short inner thread 80, wherein the outer thread 78 according to FIG. 1 is arranged above the centre part 14, i.e. above the toothing 25. With this it may be the case of a metric fine thread.

The outer thread 78 comprises a first annular groove shaped interruption location 84 which is somewhat larger than the inner thread 80. In the direction towards the surroundings 18 in the outer thread 78 there is provided a second, annular groove shaped interruption location 86 which has a length 88 of for example half a pitch height of the outer thread 78.

In FIG. 1 right of the axis 11 the protective cover 82 is shown in the unscrewed position in which its inner thread 80 is located within the first interruption location 84, i.e. in which the inner thread 80 is not in engagement with the outer thread 78 of the sleeve 12.

A threaded section 90 of the outer thread 78, which lies above the second interruption location 86, leads beyond the end of the sleeve 12, which faces the surroundings 18, by about half a thread pitch so that the sleeve 12 at this end comprises a bulge 92 which concentrically projects with respect to the axis 11 and which corresponds to an extended core of the threaded section 90. The height of the bulge 92 may likewise correspond to roughly half a thread pitch.

Left of the axis 11 the protective cover 82 is shown in the screwed in or screwed down position wherein the threaded section 90 is shown pressed into the second interruption location 86 by way of screwing down the protective lid 82, and only leaves remaining a small free space 94 of the second interruption location 86.

On the other side of the flange 30, which faces the inner space 16, with pretension a compression spiral spring 96 arranged about the shank 38 bears with its one end 98 on the contact surface 35. Its other end 100 reaches up to the end of the sleeve 12, which faces the inner space 16. This end 100 is in contact with a thrust collar 102 which for its part is in contact with a Seeger circlip ring 104 which is arranged in an annular groove 106 of the shank 38. According to the required pressure force a correspondingly strong spiral spring 96 is provided.

If the cover 82 before transfer of the timepiece to the user for the first time is completely screwed onto the sleeve 12, as is shown left of the axis 11, then this cover presses on the bulge 92 and displaces or rather squeezes the threaded section 90 into the free space 94 of the second interruption location 86. By way of this deformation of the threaded section 90 the user can certainly screw down and unscrew the lid, but this may no longer be removed and thus cannot get lost. In this position of the cover an excess pressure in the timepiece inside 16 may be compensated within a very short time.

The lid 82 may be screwed down before diving in order on the one hand by way of the threaded engagement to form a first dirt barrier, and on the other hand to compress the O-ring 44 by way of a movement of the piston 36 in the direction towards the inner space 16, additionally to the compression effect of the compression spiral spring 96, as is shown left of the axis 11.

If the pressure of the surroundings exceeds the inner pressure of the timepiece, then on the one hand the lip 54 is pressed onto the walling of the bore 28 and on the other hand the piston 36 is driven in the direction of the inner space 16 by which means the O-ring 44 is compressed by the conical contact surface 39 of the piston 36 and bears rigidly on the four contact regions 31, 39, 41, and 42. This effect is supported by the conical shaping of the head 74 of the cylinder 36. With an external excess pressure the sealing effect of the valve 10 according to the invention is therefore increased twice in that on the one hand the lip 58 closes more strongly and on the other hand the O-ring is more strongly compressed. It is however to be expressly mentioned that already the effect of the lip seal 56 alone is sufficient to meet the demands as for example occur on diving. As mentioned the lip seal 56 with the suggested orientational assembly has the advantage that the bearing pressure of the skirt-shaped lip 58 running out for example in a pointed manner increases with an increasing excess pressure of the surroundings.

Reversely the lip 58 with an excess pressure in the timepiece is deformed in a manner such that it is pressed away from the bore walling 29 towards the axis 11 and permits a rapidly effected relieving of the inner space 16 of the timepiece.

By way of the fact that the lip seal 56 is the component lying closest to the surroundings 18 and that it functions as a dirt stripper, particles of dirt cannot penetrate further in the direction of the inner space 16.

The angles 64 and 68 incorporated into FIG. 1 do not necessarily need to correspond to the selected 10° or 45°. The angle 64 of the wedge-shaped free space 62 is decisive for the opening behaviour of the lip seal with an inner excess pressure and must therefore as a rule be smaller than 90°. The angle 68 on the other hand is decisive for the closing and sealing behaviour of the lip seal with an outside excess pressure and must therefore as a rule likewise be smaller than 90°. Thus the lip itself has an angle which lies between 0° and 90°, wherein here it must be stated that the shape of this lip does not need to correspond to that of the FIG. 1. For example the two surfaces 64 and 68 could also run parallel to one another, instead of opening out into a pointed edge region 67. The edge region 67 likewise need not be formed pointed, but may be relatively thick depending on the demands on the lip seal. The dirt deflecting function is however accomplished particularly well with an edge region 67 running out in a pointed manner. According to FIG. 1 the lip 58 bears on the surface 29 of the sleeve essentially only in the edge region 67 thereof. of course the contact surface between the lip 58 and the surface 29 may also be considerably larger and assume the shape of a cylinder jacket.

According to the FIG. 1 the lip seal 56 is fixed on the cylinder 36. As a rule however it is also possible to fix the base region of the lip seal in a groove provided inside in the sleeve 12, whilst the lip leads conically to the axis and bears externally on the piston. For this, proceeding from FIG. 1, the cross section of the lip seal 56 would have to be mirrored on a vertical axis.

Furthermore it is also possible to provide the lip seal on the outside on the sleeve, i.e. for example between the sleeve and the lid, wherein the lip in this case is directed towards the timepiece. Proceeding from FIG. 1 for this the cross section of the lip seal 56 would thus have to be mirrored on a horizontal axis. Also here the lip seal may either be fixed in the sleeve or in the cover, whilst is lip in each case bears on the other component.

It is decisive that the lip closes when the outer pressure is larger than the pressure in the inside of the timepiece and that it opens when an inner excess pressure is present.

It is generally advantageous to provide the lip seal, which acts as a dirt barrier, as far outside as possible in the safety valve, as is shown in FIG. 1, i.e. to so arrange the transition between the surroundings and the inner space that where possible all components of the safety valve are not subjected to the surroundings. In this sense the intermediate region 65 already no longer belongs to the surroundings, since it is shielded from this by way of the lip seal 56. Dirt particles with this embodiment form do not even gain initial access to the various components such a the O-rings, threads etc.

Further it is to be mentioned that the overhanging bulge 92 of FIG. 1 of course does not need to be provided when the cover for example comprises an annular projection which axially acts on the threaded section 90

As a rule the arrangement of the lip seal is possible at various locations of the operating means according to the invention, but its orientation is of a decisive importance. As has already been stated several times the elastic lip is to be directed such that it closes when the outer pressure is greater than the pressure in the inside of the timepiece, and that it opens when an inner excess pressure is present. For this an extremely slight deformation of the lip is generally already sufficient.

Of course there may also be provided several lip seals placed behind one another with regard to their effect.

What is claimed is:

1. A safety valve for a timepiece, which comprises an element rigid with a housing, a further element as well as a seal arranged between the two elements, the seal delimiting the timepiece inner space from the surroundings, wherein:

the seal is a lip seal which comprises a base region as well as a rotationally symmetric lip, the base region is arranged stationarily in a first of said elements, the lip bears on a cylinder jacket shaped surface region of a second of said elements and the lip extends from the base region in the direction of the surroundings, has a conical shape and bears on said cylindrical surface region with pretensioning, in order on the one hand to release itself from the surface region for the purpose of pressure compensation between the inner space and the surroundings given an inner space excess pressure and in order on the other hand to be more strongly pressed on the surface region for the purpose of sealing the inner space with respect to the surroundings given an excess pressure of the surroundings.

2. A safety valve according to claim 1, wherein the lip comprises two rotationally symmetric surface zones, of which a first of these surface zones faces the timepiece inner space and the second of these surface zones is in contact with the surroundings.

3. A safety valve according to claim 1, wherein the further element with respect to the element rigid with the housing is movable at least in the direction of one axis.

4. A safety valve according to claim 3, wherein the movable element is at least partly enclosed by the element rigid with the housing.

5. A safety valve according to claim 4, wherein the base region is arranged in a stationary manner in the movable element and the cylinder jacket shaped surface region is provided on the inner side on the element rigid with the housing.

6. An safety valve according to claim 4, wherein the base region is arranged in a stationary manner in the element rigid with the housing and the cylinder jacket shaped surface region is provided on the outer side on the movable element.

7. A safety valve according to claim 1, wherein the safety valve comprises a further seal.

8. A safety valve according to claim 7, wherein the further seal is arranged on the inner space side of the lip seal and between it and the lip seal, or between the surroundings and the inner space there forms an intermediate space.

9. A safety valve according to claim 8, wherein the further seal is an O-ring.

10. A safety valve according to claim 7, wherein the further element is a piston which with respect to the element rigid with the housing is displaceable at least in the direction of one axis and on which the base region is mounted in a stationary manner, and that the piston can compress the further seal.

11. A safety valve according to claim 10, wherein there is provided a cover which can be screwed onto the element rigid with the housing, in order, for the purpose of compressing the further seal, to permit the displacing of the piston.

12. A safety valve according to claim 11, wherein the element rigid with the housing comprises a threaded section which is separated from the remaining thread by an interruption location, so that on screwing on the lid for the first time, a deformation of the threaded section is possible.

13. A safety valve according to claim 12, wherein there is provided a spring which pretensions the further sealing element.

14. A timepiece with the safety valve according to claim 1.

15. A safety valve for a timepiece, which comprises an element rigid with a housing, a further element as well as a seal arranged between the two elements, the seal delimiting the timepiece inner space from the surroundings, wherein:

the seal is a lip seal which comprises a base region as well as a rotationally symmetric lip, the base region is arranged stationarily in a first of these elements, the lip bears on a cylinder jacket shaped surface region of a second of these elements and the lip extends from the base region in the direction of the surroundings, has a conical shape and bears on said cylindrical surface region with pretensioning, the lip comprises two rotationally symmetric surface zones, of which a first of these surface zones is in contact with the surroundings.

the first surface zone essentially proceeding from the base region and facing in the direction of the surroundings, leads conically to the cylinder jacket shaped surface region, between the first surface zone and the cylinder jacket shaped surface region there is provided a rotationally symmetric free space which in cross section is formed essentially wedge-shaped and is delimited from the surroundings by the lip, and the second surface zone essentially, proceeding from the base region and facing in the direction of the surroundings, leads conically to the cylinder jacket shaped surface region, in order on the one hand to release itself from the surface region for the purpose of pressure compensation between the inner space and the surroundings given an inner space excess pressure and in order on the other hand to be more strongly pressed on the surface region for the purpose of sealing the inner space with respect to the surroundings given an excess pressure of the surroundings.

16. A safety valve according to claim 15, wherein the two surface zones approach in the direction towards the cylinder jacket shaped surface region and open into an essentially pointedly formed lip edge.

17. A safety valve according to claim 16, wherein the second surface zone at the base region blends into a curving.

* * * * *